US005172490A

United States Patent [19]

Tatsumi et al.

[11] Patent Number: 5,172,490

[45] Date of Patent: Dec. 22, 1992

[54] CLOTHES DRYER WITH NEUROCONTROL DEVICE

[75] Inventors: Hisao Tatsumi, Nagoya; Takashi Kawano, Seto; Norisuke Fukuda, Tokyo, all of Japan

[73] Assignee: Kabushiki Kaisha Toshiba, Kanagawa, Japan

[21] Appl. No.: 803,195

[22] Filed: Dec. 5, 1991

[30] Foreign Application Priority Data

Feb. 28, 1991 [JP] Japan ..... 3-58356

[51] Int. Cl.[5] ..... F26B 21/00

[52] U.S. Cl. ..... 34/54; 34/73

[58] Field of Search ..... 34/43, 45, 54, 73, 76; 395/22, 23

*Primary Examiner*—Henry A. Bennet

*Attorney, Agent, or Firm*—Philip M. Shaw, Jr.

[57] ABSTRACT

A clothes dryer of the dehumidification type is disclosed in which hot air induced by a heater is circulated from a drying compartment through a heat exchanger. A volume, wetness, wetness unevenness, temperature, temperature unevenness of clothes to be dried and the temperature of the hot air blown out of the drying compartment are detected by respective detectors. Results of detection are input to a control device incorporating a neural network. The control device operates in the manner of neurocontrol to control a volume of outside air supplied to the heat exchanger and a heating value of the heater.

5 Claims, 16 Drawing Sheets

CLOTHES DRYER WITH NEUROCONTROL DEVICE

BACKGROUND OF THE INVENTION

This invention relates to a clothes dryer of the dehumidification type, and more particularly to such a clothes dryer wherein a neurocontrol is provided for controlling the operation thereof for improvement of the drying efficiency.

Clothes dryers of the dehumidification type are well known in the art. In this type of clothes dryers, hot air induced by a heater is circulated from a drying compartment containing clothes to be dried, through a heat exchanger so that moisture is removed by the heat exchanger from the clothes, thereby drying the clothes.

In the above-described conventional clothes dryer, however, the heater is arranged to start inducing heat immediately when clothes to be dried are contained in a drying compartment and the operation of the dryer is initiated. Supply of cooling air to the heat exchanger is simultaneously initiated. The temperature of the hot air induced by the heater is not so high at an initial drying stage that moisture cannot be sufficiently exhaled from the clothes. In this condition, the hot air from the drying compartment reaches the heat exchanger in which the hot air is cooled by the cooling air supplied to the heat exchanger. The temperature of the hot air is thus prevented from being raised, which delays heating to the clothes. Consequently, a drying period is prolonged.

When the clothes dryer is used almost everyday, the value of temperature required for the drying operation depends upon a volume of clothes to be dried, the degree of wetness of the clothes, a volume of cooling air supplied to the heat exchanger, and the heating value of the heating. Accordingly, the atmospheric temperature in the drying compartment tends to be increased when the volume of the clothes is small or the degree of wetness of the clothes is low while the atmospheric temperature in the drying compartment tends to be decreased when the volume of the clothes is large or the degree of wetness of the clothes is high. Consequently, modes of the drying operation are changed depending upon the inner condition of the drying compartment and the atmospheric temperature in the dying compartment becomes extremely high or low.

Furthermore, since the clothes become almost moistureless at a final stage of the drying operation, the atmospheric temperature in the drying compartment is rapidly increased. In such a condition, the heat exchanger functions only to cool most of the heat generated by the heater.

The heat efficiency is low throughout the drying operation in the conventional clothes dryer of the dehumidification type. Consequently, drying clothes is time-consuming and the electric charges are increased.

SUMMARY OF THE INVENTION

Therefore, an object of the present invention is to provide a clothes dryer wherein the drying operation can be performed with a high level of heat efficiency.

To achieve the above-described object, the present invention provides a clothes dryer in which hot air induced by a heater is circulated from a drying compartment through a heat exchanger for drying clothes, comprising detecting means for detecting states of clothes to be dried and the like, intake air volume adjusting means for adjusting a volume of cooling intake air supplied to the heat exchanger, and control means for controlling the intake air volume adjusting means by way of a neurocontrol based on the result of detection by the detecting means so that the volume of cooling intake air is adjusted.

The state of the clothes to be dried and the like is detected and the volume of cooling intake air supplied to the heat exchanger is adjusted based on the result of the detection. A most suitable training pattern is input to a neural network of the neurocontrol in the control means at the developmental stage of the dryers, and an adjusted volume of cooling intake air is previously learned by the neural network. Consequently, the adjusted volume of cooling intake air can be obtained in accordance with different conditions by changing weighting factors of the neural network and the like.

A heating value of the heater may also be controlled by the control means by way of the neurocontrol based on the result of detection by the detecting means. An optimum heating value of the heater can be obtained based on the result of detection by the detecting means in accordance with different conditions.

The detecting means may comprise clothes volume detecting means for detecting a volume of clothes to be dried, wetness detecting means for detecting wetness of the clothes to be dried, and hot air temperature detecting means for detecting the temperature of the hot air blown out of the drying compartment. In this case the state of the clothes and the like can be detected in detail and accordingly, a more suitable adjusted volume of cooling intake air supplied to the heat exchanger and a more suitable heating value can be obtained.

Furthermore, the detecting means may comprise clothes volume detecting means for detecting a volume of clothes to be dried, wetness detecting means for detecting wetness of the clothes to be dried, wetness unevenness detecting means for detecting a degree of wetness unevenness of the clothes to be dried, clothes temperature detecting means for detecting the temperature of the clothes to be dried, clothes temperature unevenness detecting means for detecting a degree of temperature unevenness of the clothes to be dried, and hot air temperature detecting means for detecting the temperature of the hot air blown out of the drying compartment. In this case, too, a more suitable adjusted volume of cooling intake air supplied to the heat exchanger and a more suitable heating value can be obtained.

Other objects of the present invention will become obvious upon understanding of the illustrative embodiments about to be described or will be indicated in the appended claims. Various advantages not referred to herein will occur to one skilled in the art upon employment of the invention in practice.

BRIEF DESCRIPTION OF THE DRAWINGS

The invention will be described by way of example with reference to the accompanying drawings in which.

DESCRIPTION OF THE PREFERRED EMBODIMENTS

A first embodiment of the present invention will be described with reference to FIGS. 1 to 18 of the accompanying drawings.

Figure 2:
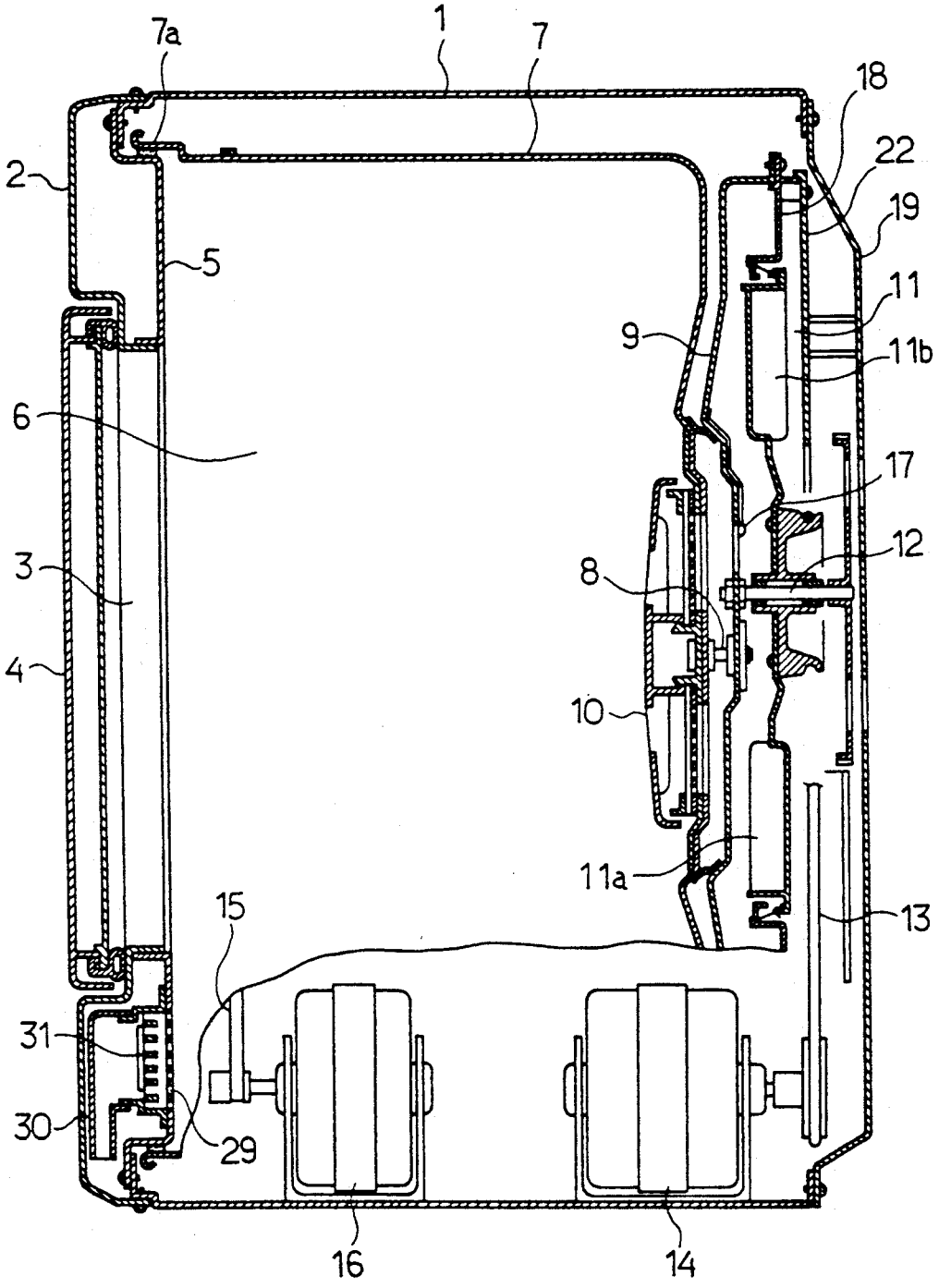
FIG. 2 is a longitudinal sectional view of the clothes dryer.

Referring first to FIG. 2, an overall construction of the clothes dryer in accordance with the invention will be described. An outer cabinet 1 includes a front cover 2 defining an opening 3 through which clothes to be dried are put into and taken out of a drying compartment 6. A door 4 for opening and closing the opening 3 is pivotally mounted on the front cover 2. An inward drum support 5 is also attached to the front cover 2. A drum 7 is provided in the outer cabinet 1 for defining the drying compartment 6. The drum 7 has a front opening edge 7*a* fitted with the drum support 7. The drum 7 further includes a drum shaft 8 mounted on the center of a rear wall thereof. The drum shaft 8 is supported on the front center of a fan casing 9 provided in the rear inside of the outer cabinet 1. A filter 10 is attached to the central part of the rear wall of the drum 7.

A fan 11 mounted in the fan casing 9 is provided with a heat exchanging function as well as a fanning function. The fan 11 is of the type that front and rear vane portions 11*a* and 11*b* are provided. The fan 11 is mounted on a shaft 12. First and second electric motors 14 and 16 are mounted on the bottom of the outer casing 1 for driving the fan 11 via respective belts 13 and 15. A first temperature sensor 17 comprising a thermistor is disposed at the front inlet of the fan casing 9 facing the drum 7. The first temperature sensor 17 serves as hot air temperature detecting means for detecting the temperature of hot air blown out of the drying compartment 6. A casing cover 18 is attached to the fan casing 9 so as to be air-tightly in contact with the outer periphery of the fan 11.

Figure 3:
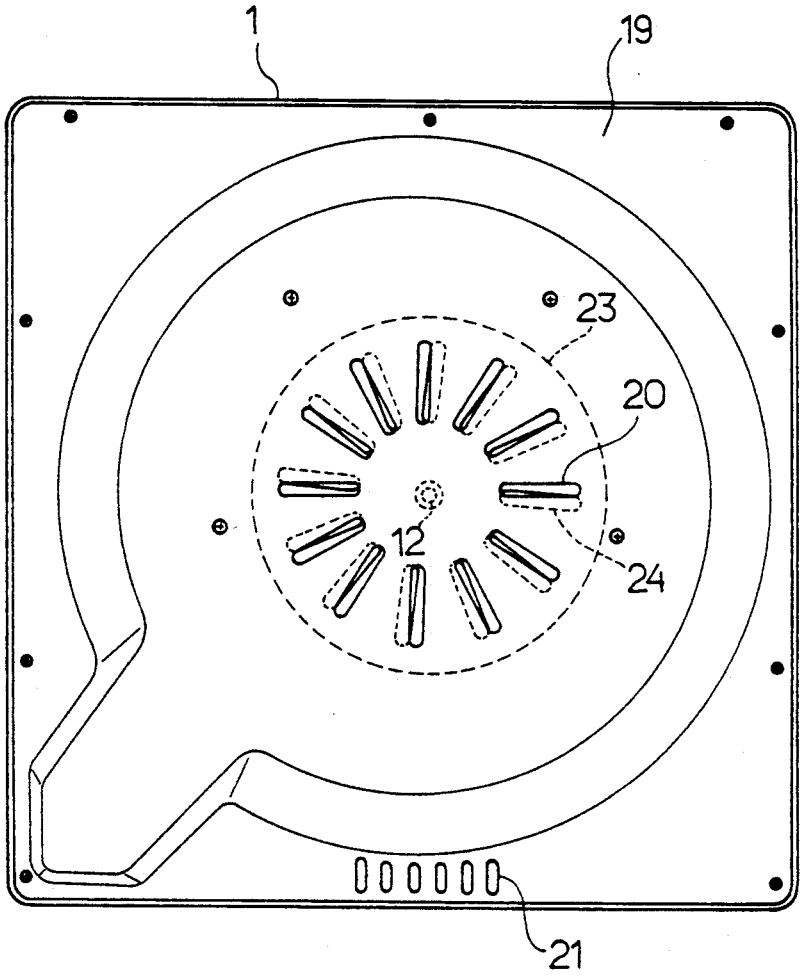
FIG. 3 is a rear elevation of the clothes dryer.
Figure 4:
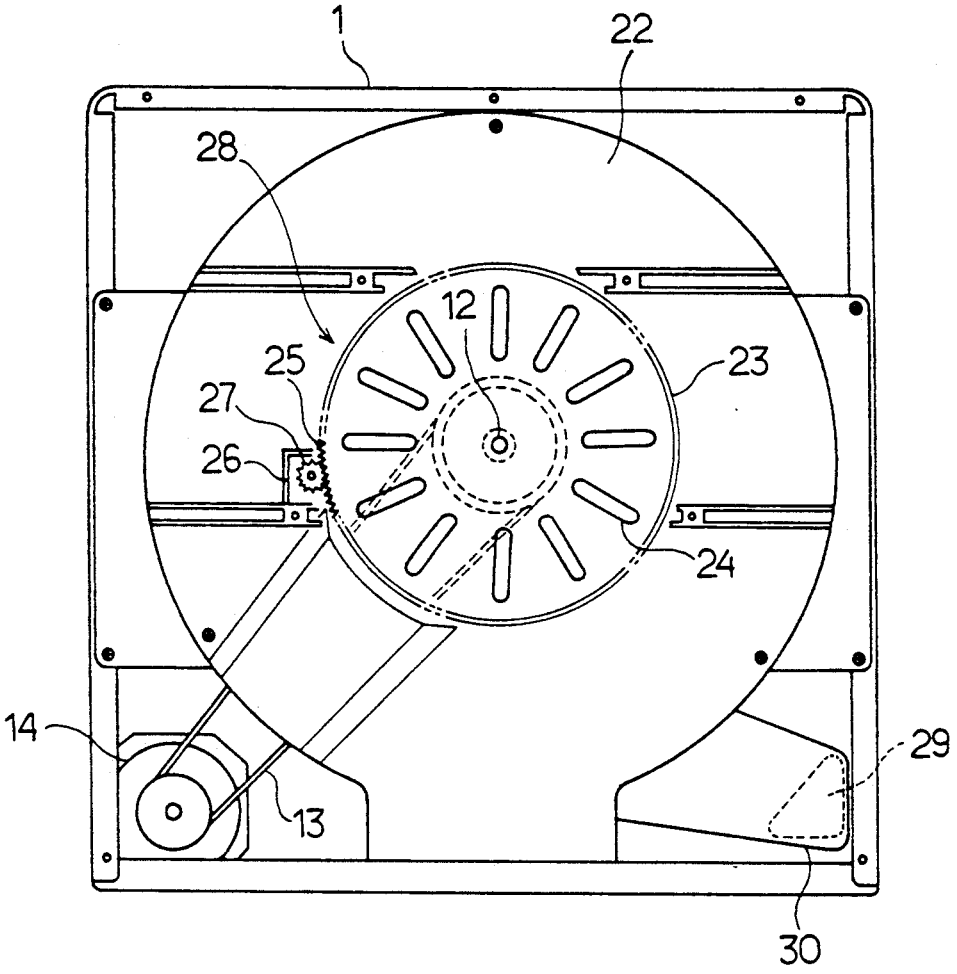
FIG. 4 is a rear elevation of the clothes dryer with a rear cover removed.

A rear cover 19 has a number of central outside air inlets 20 comprising radially formed slits, as shown in FIG. 3. The rear cover 19 also has a number of outside air outlets 21 formed in its central lower portion, the outlets comprising slits laterally aligned. An annular cover plate 22 is attached to the casing cover 18 between the fan 11 and the rear cover 19, as shown in FIGS. 2 and 4. A damper disk 23 is mounted on the shaft 12. Radial slits or outside air inlets 24 are formed in the damper disk 23 in the same manner as in the inlets 20. Gear teeth 25 are formed over the outer periphery. A third electric motor 26 has a shaft on which a gear 27 is mounted. The gear 27 is in mesh engagement with the gear teeth 25. Thus, a damper mechanism 28 serving as intake air volume adjusting means comprises the damper disk 23, the third motor 26 and the gear 27.

FIG. 4 shows an air circulation duct 30 communicating to a hot air outlet 29 (see FIG. 2) extended from the lower portion of the fan casing 9 to the lower portion of the drum support 5. Three heaters 31, for example, are mounted on the air circulation duct 30 so as to face the hot air outlet 29, as shown in FIG. 5.

Figure 5:
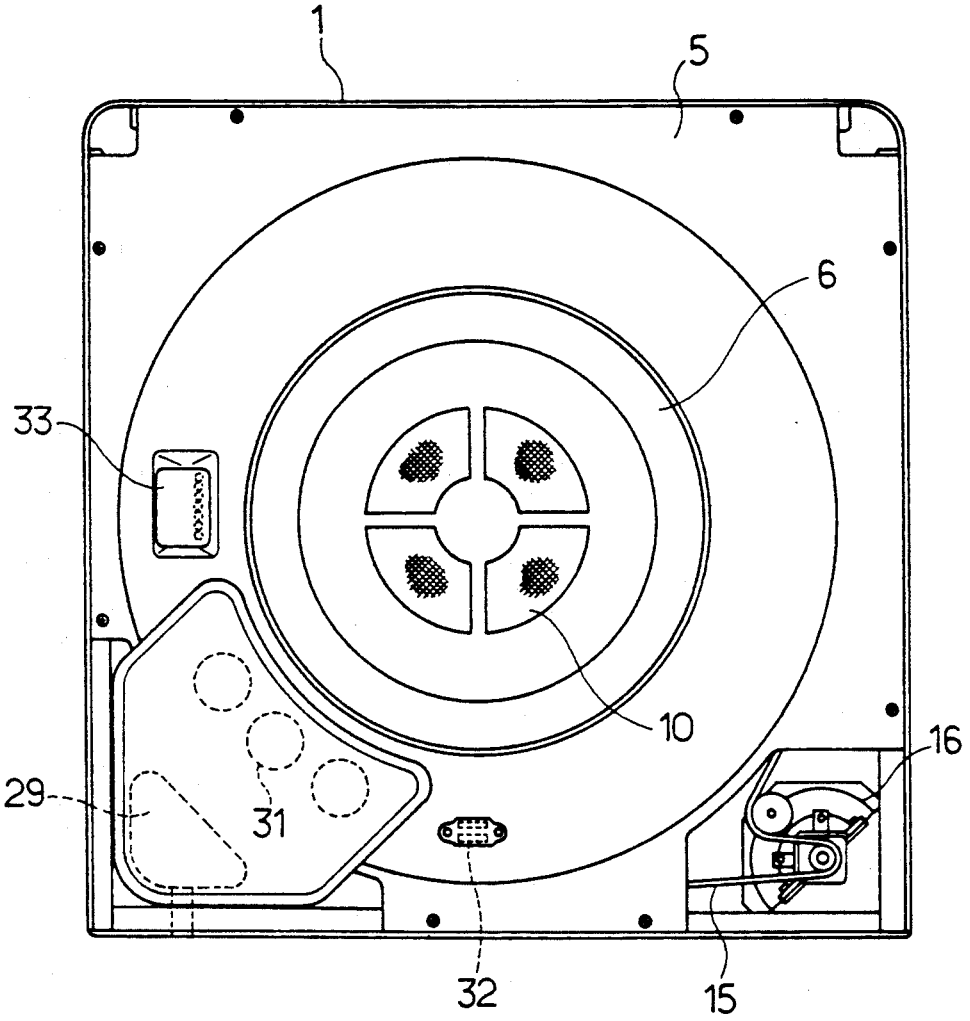
FIG. 5 is a front view of the clothes dryer with a front cover removed.

Referring further to FIG. 5, a pair of electrodes 32 are provided on the lower portion of the drum support 5 facing the interior of the drum 7 or the drying compartment 6. The electrodes 32 serve as clothes volume detecting means for detecting a volume of clothes to be dried, wetness detecting means for detecting wetness of the clothes to be dried, and wetness unevenness detecting means for detecting a degree of wetness unevenness of the clothes to be dried. A second temperature sensor 33 is provided on the left-hand portion of the drum support 5, as viewed in FIG. 5. The second temperature sensor 33 comprises a number of pyroeletric elements longitudinally aligned, for example. The second temperature sensor 33 serves as clothes temperature detecting means for detecting the temperature of the clothes to be dried, clothes temperature unevenness detecting means, and wetness unevenness detecting means for detecting a degree of wetness unevenness of the clothes to be dried.

Figure 6:
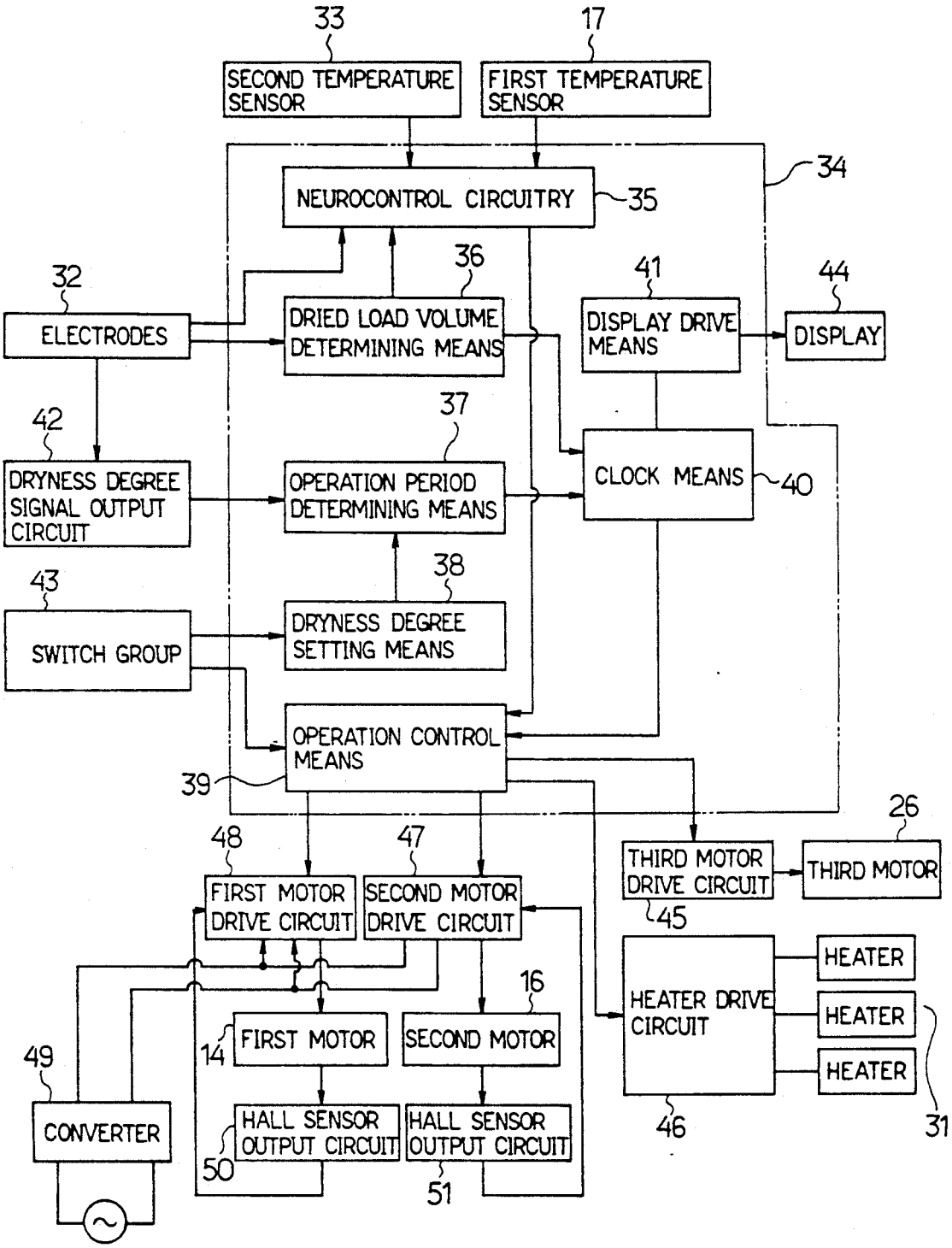
FIG. 6 is a block diagram showing an electrical arrangement of the clothes dryer.

A control device 34 which is a main composite part of the control circuitry shown in FIG. 6 is provided in the upper interior of the outer cabinet 1. The control device 34 comprises a microcomputer, neurocontrol circuitry 35, dried load volume determining means 36, operation period establishing means 37, dryness level setting means 38, operation control means 39, clock means 40, and display drive means 41. Detection signals generated by the first and second temperature sensors 17, 33 are input to the neurocontrol circuitry 35. A detection signal generated by the electrodes 32 is input to both of the neurocontrol circuitry 35 and the dried load volume determining means 36. The detection signal from the electrodes 32 is further input to the operation period establishing means 38 through a dryness level signal output circuit 42. Operation signals from a switch group 43 are input to both of the dryness level setting means 38 and the operation control means 39. Based on these inputs and a previously stored control program, the control device 34 controls a display 44 via the display drive means 41, the third motor 26 via the operation control means and a third motor drive circuit 45, the heater 31 via a heater drive circuit 46, the second motor 16 via a second motor drive circuit 47, and the first motor 14 via a first motor drive circuit 48.

An inverter device (not shown) is provided for both the first and second motor drive circuits 48, 47. A converter 49 is provided for converting commercial ac power to dc power. The dc power is converted by the inverter to ac power, which ac power is supplied to the first and second motors 14, 16. The first and second motor drive circuits 48, 47 are supplied with feedback signals from Hall elements (not shown) provided in the motors 14, 16, via Hall sensor output circuits 50 and 51, respectively so that the output frequencies of the drive circuits 48, 47 are varied, thereby controlling the speed of each of the motors 14, 16.

Figure 1:
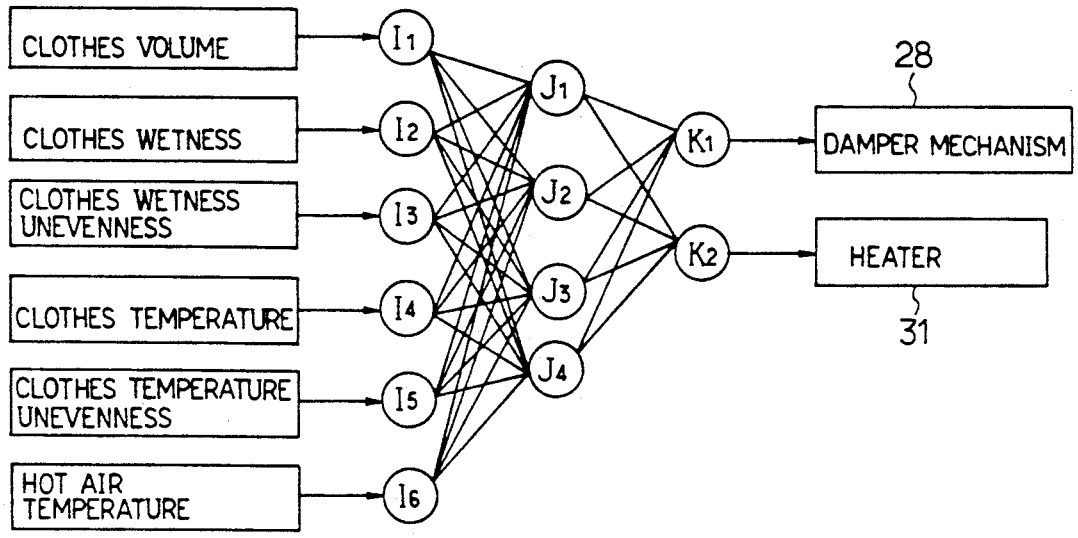
FIG. 1 schematically illustrates a neurocontrol employed in a clothes dryer of one embodiment of the invention.

The neurocontrol circuitry 35 comprises a neural network as shown in FIG. 1. Although the neural network is actually composed in software, it is shown in the embodiment as composed in hardware for the purpose of description.

The neural network comprises an input layer including six units $I_1$ to $I_6$. The signal generated by the electrodes 32 in regard to the volume of clothes to be dried is input to the unit $I_1$ as the detection data. The signal generated by the electrodes 32 in regard to the wetness of the clothes to be dried is input to the unit $I_2$ as the detection data. The signals generated by the electrodes 32 and the second temperature sensor 33 in regard to the unevenness of the wetness of the clothes to be dried are input to the unit $I_3$ as the detection data.

Figure 7:
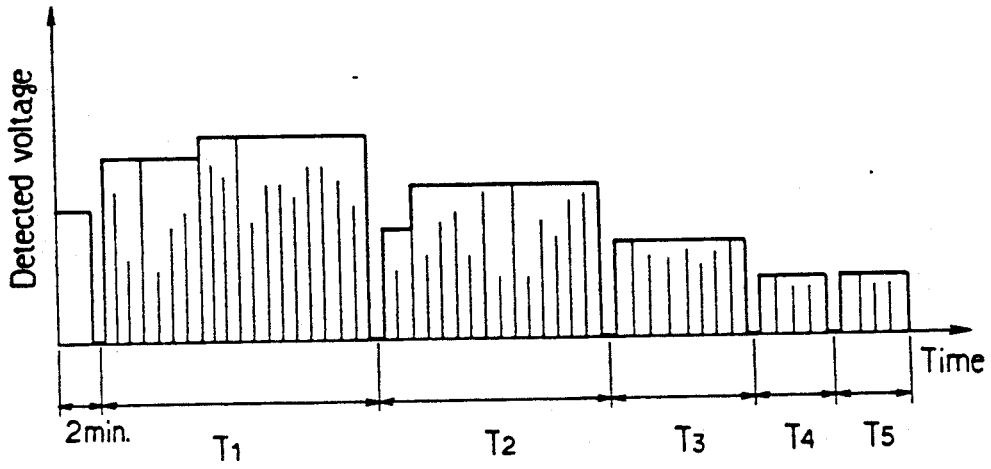
FIG. 7 is a graph showing signals generated at a pair of electrodes for detecting moistness unevenness of the clothes.
Figure 8:
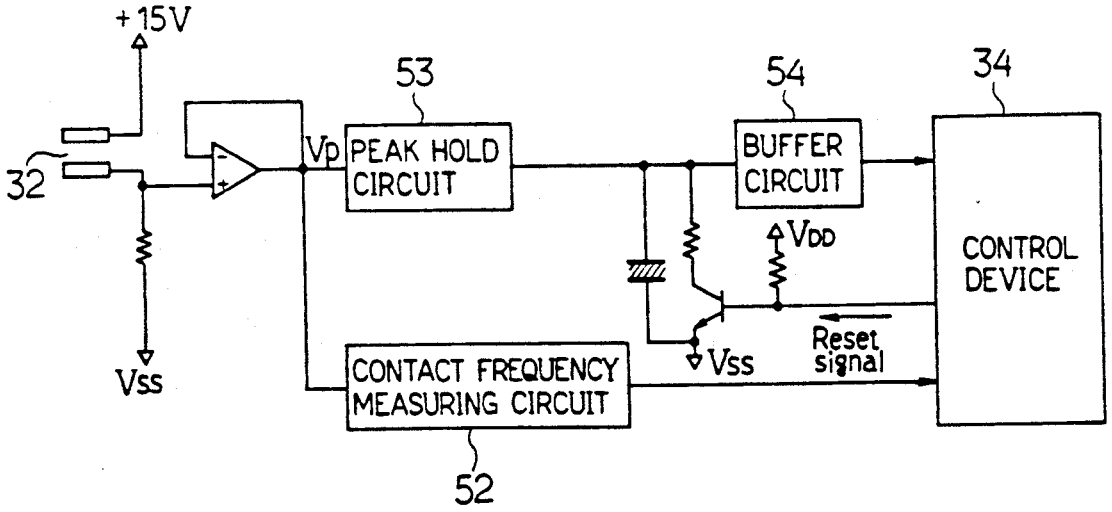
FIG. 8 is a diagram of an electric circuit for processing the signals generated by the pair of electrodes.
Figure 9:
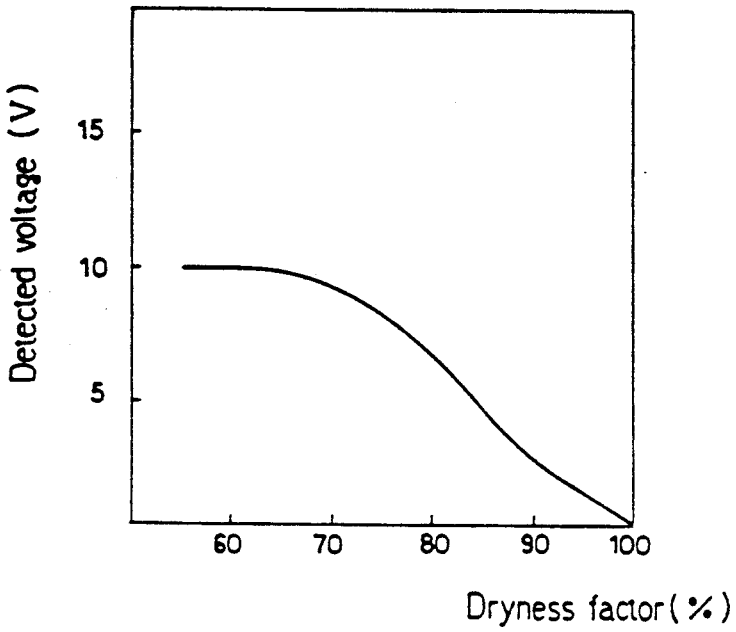
FIG. 9 is a graph showing the detected voltage versus dryness factor characteristic.

The signals generated by the electrodes 32 are obtained as the result of contact of the electrodes 32 with the clothes agitated by rotation of the drum 7 as will be described later. FIG. 7 shows an example of such signal generated by the electrodes 32. The voltage is measured every 8 milliseconds for initial 2 minutes. Relatively high voltage is generated every time the wet clothes are brought into contact with the electrodes 32. The number of generations of the high voltages is counted by a contact frequency measuring circuit 52 as shown in FIG. 8, thereby determining the volume of clothes to be dried. Data of the determined clothes volume is input to the unit $I_1$ as the detection data. The voltage generated every time the clothes are brought into contact with the electrodes 32 is also representative of the wetness of the clothes. The voltage is gradually reduced as the drying progresses, as shown in FIG. 9. The voltage is supplied to a peak hold circuit 53 and a buffer circuit 54 in turn so that the wetness of the clothes to be dried is determined. Data of the determined clothes wetness is input to the unit $I_2$ as the detection data. Furthermore, the above-described voltage varies when the wetness of the clothes is uneven. The degree of the wetness unevenness of the clothes is determined when the voltage is supplied to the peak hold circuit 53 and the buffer circuit 54 in turn. Detection data of the wetness unevenness of the clothes is input to the unit $I_3$.

The unit $I_4$ of the input layer of the neural network is supplied with detection data based on the signal generated by the second temperature sensor 33 sensing the temperature of the clothes to be dried. The unit $I_5$ is supplied with detection data based on the signal generated by the second temperature sensor 33 sensing the temperature unevenness of the clothes to be dried.

Figure 10:
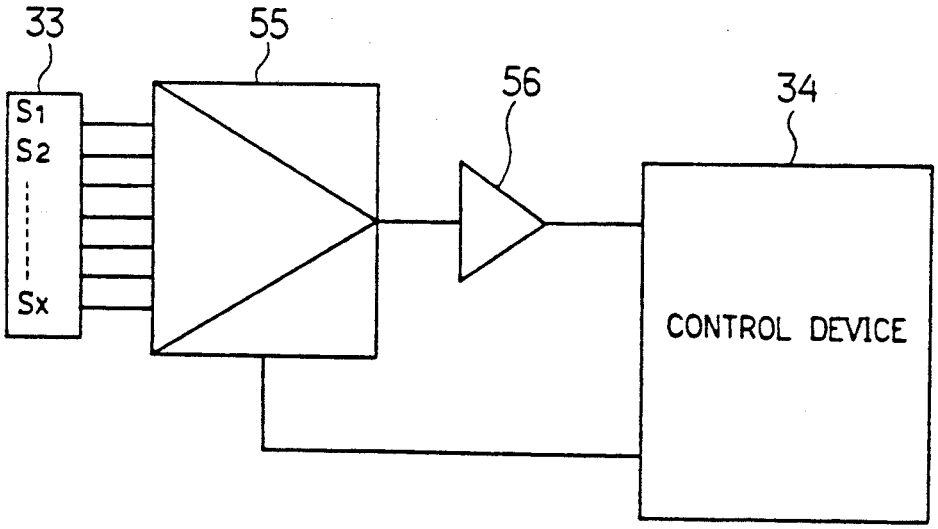
FIG. 10 is a diagram of an electric circuit for processing signals generated by a second temperature sensor.
Figure 11:
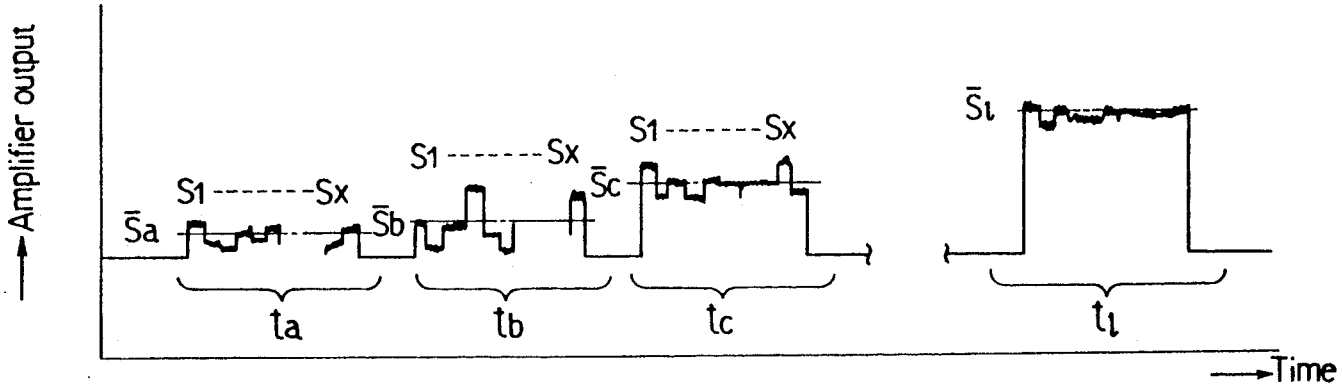
FIG. 11 is a graph showing detection data obtained by processing the signals generated by the second temperature sensor.

The signals generated by the second temperature sensor 33 are also obtained as the result of contact of the sensor 33 with the clothes agitated by rotation of the drum 7. As shown in FIG. 10, the temperature radiation is measured in a predetermined range by the pyroeletric elements $S_1$ to $S_x$ of the second temperature sensor 33. Data of the measured temperature radiation is supplied to a change-over circuit 55 and then, supplied to the units $I_4$, $I_5$ through an amplifier 56. FIG. 11 shows output data of the amplifier 56. The temperature of the clothes is determined from mean values $S_a$ to $S_1$. Furthermore, the temperature unevenness of the clothes is determined from the maximum and minimum mean values.

Figure 12:
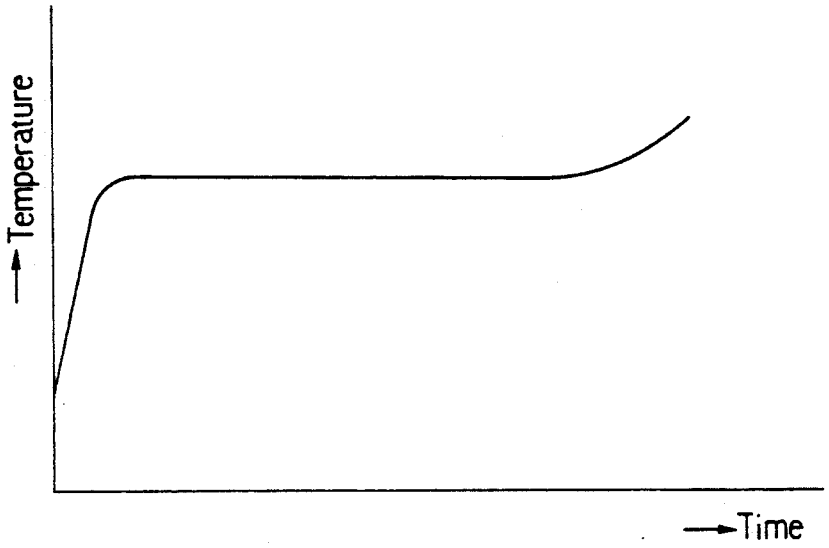
FIG. 12 is a graph showing changes of the temperature sensed by a first temperature sensor.

The unit $I_6$ is supplied with detection data based on the signal generated by the first temperature sensor 17 sensing the temperature of the hot air blown out of the drying compartment 6. FIG. 12 shows the signal generated by the first temperature sensor 17.

Referring again to FIG. 1, a middle or hidden layer of the neural network includes units $J_1$ to $J_4$. Each unit $J_1$–$J_4$ is connected to the units $I_1$ to $I_6$ of the input layer by links. The neural network further comprises an output layer including units $K_1$ and $K_2$. Each unit $K_1$, $K_2$ is connected to the units $J_1$–$J_4$ of the hidden layer by links. An output of the unit $K_1$ of the output layer is for the control of the third motor 26 (damper mechanism 28) and an output of the unit $K_2$ is for the control of the heater 31.

The operation of the clothes dryer will be described. First, the principle of the neural network employed for the neurocontrol will be outlined.

Figure 13:
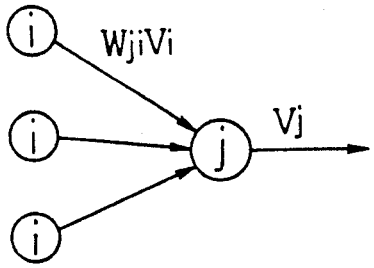
FIG. 13 is a schematic view of the principle of the neural network.
Figure 14:
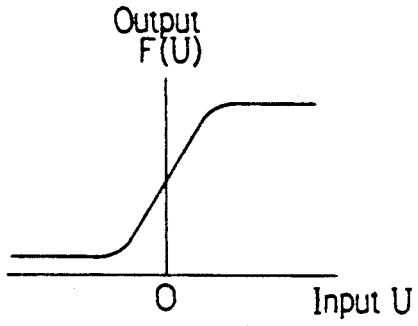
FIG. 14 is a graph showing a sigmoid function.

The neural network simulates a human nerve net and is a network comprising units and links or connections as shown in FIG. 13. A unit j has an input and output characteristic $F_j(U_j)$ as shown in FIG. 14. The reference $F_j$ designates a sigmoid function expressed as follows:

$$F_j(U_j) = \frac{1}{1 + \exp(U_j + \theta_j)} \tag{1}$$

An output $V_j$ of the unit j is shown by the following equation:

$$V_j = F_j\left(\sum_{i \neq j} W_{ji} V_i + \theta_j\right) \tag{2}$$

where $V_i$ is an output of another unit i, $W_{ji}$ is a weight factor indicative of the degree of influence of the unit i output upon the unit j, and $\theta_j$ is a threshold value.

Figure 15:
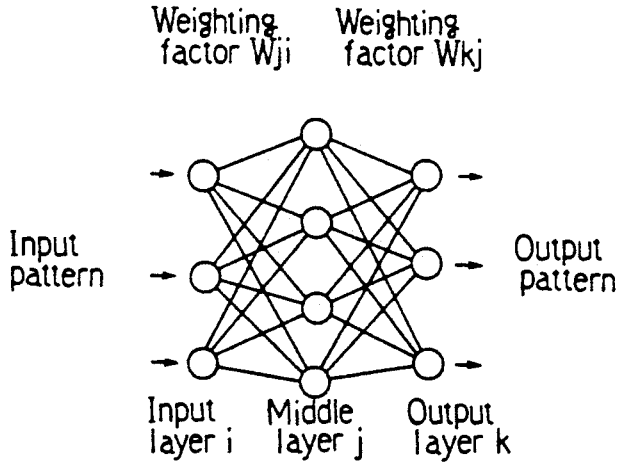
FIG. 15 is a basic diagram of the neural network.

The neural network is classified into an interconnection type, a layered type and an intermediate type depending upon a manner of connection of the links. An example of the layered neural network is shown in the embodiment. FIG. 15 illustrates a three-layer neural network in which the units are provided to form an input layer, a middle or hidden layer and an output layer. Three groups of units are distinguished from one another by indexes i, j and k in the drawings. The signal is transmitted from the input layer through the middle layer to the output layer only in one way in the above-described neural network. The weight factor $W_{kj}$ is set for the links between the input layer and the middle layer and the weight factor $W_{ji}$ is set for the links between the middle layer and the output layer. The neural network is composed of a large number of units as simple processing elements. Each unit produces a large output when the sum total of inputs from the other units exceeds a threshold value.

The neural network is characterized by its learning ability, high speed processing and noise proof. The learning of the neural network is performed by adjusting the weight factor of the link so that a suitable output pattern (training pattern) is obtained in regard to an input pattern (example). In this case the weight factor is initially set to a random value. After learning, a plurality of pairs of learned input and output patterns are related to one another and suitable output patters can be obtained by analogy for the input patterns other than those learned in the neural network. One of learning methods of the neural network is a back propagation method. In the back propagation method, the weight factor is adjusted by an error function between a suitable output pattern (training pattern) and an actual output pattern. The error function E is defined in the neural network in FIG. 15 as follows:

$$E = \frac{1}{2} \sum_k (T_k - V_k)^2 \tag{3}$$

where $T_k$ and $V_k$ are training data (desired output data) and actual output data of the unit k of the output layer respectively. The output data $V_k$ is shown by the following equation:

$$V_k = F_k(U_k) \tag{4}$$

where $$U_k = \sum_j W_{kj} V_j + \theta_k. \tag{5}$$

In the back propagation method, a volume of modification of the weight factor is calculated and the modification is repeated until the value of the weight factor is below a preselected value. More specifically, the amounts $\Delta W_{kj}$ and $\Delta W_{ji}$ of modification of the weight factor are obtained by the following equations:

$$\Delta W_{kj} = \eta \delta_k V_j \tag{6}$$

$$\Delta W_{ji} = \eta \delta_j V_i \tag{7}$$

where $$\delta_k = (T_k - V_k) F_k'(U_k), \tag{8}$$

$$\delta_j = F_j'(U_j) \sum_k \delta_k W_{kj}, \text{ and} \tag{9}$$

$\eta$ is a constant determined in consideration of the speed of modification of the weight factor and stability of the calculation. New weight factors $W_{kj}'$ and $W_{ji}'$ are calculated from the amounts of modification $\Delta W_{kj}$ and $\Delta W_{ji}$ as follows:

$$W_{kj}' = W_{kj} + \Delta W_{kj}. \tag{10}$$

$$W_{ji}' = W_{ji} + \Delta W_{ji}. \tag{11}$$

Learning is transferred to a subsequent teacher pattern after the calculation of the new weight factors $W_{kj}$ and $W_{ji}$.

Figure 16:
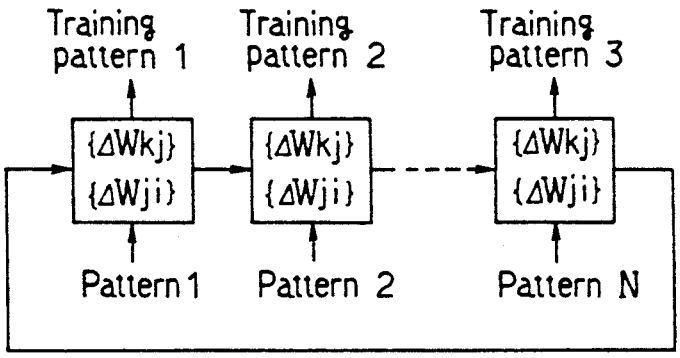
FIG. 16 is a view showing a procedure of the back propagation method.

FIG. 16 illustrates a procedure of learning. When N number of pairs of the input patterns and the teacher patterns are learned, the amounts of modification $\Delta W_{kj}$ and $\Delta W_{ji}$ are first calculated in the input pattern 1 and then, the weight factors are modified based on the calculated amounts of modification $\Delta W_{kj}$, $\Delta W_{ji}$. Then, the amounts of modification $\Delta W_{kj}$ and $\Delta W_{ji}$ are calculated in the input pattern 2 and the weight factors are modified based on the calculated amounts of modification $\Delta W_{kj}$, $\Delta W_{ji}$. Similarly, the weight factors are thus modified from the input pattern 3 to the input pattern N. When the amounts of modification $\Delta W_{kj}$, $\Delta W_{ji}$ are not below the predetermined value, the modification is repeated from the input pattern 1 to the input pattern N. Learning is completed when the amount of modification are below the predetermined value.

The neural network as described above can be arranged in hardware by employing a neurochip called "neuroprocessor" and the like or in software by employing a microcomputer. As described above, the neural network in the embodiment is arranged in software by employing the microcomputer, as shown in FIG. 1. Each of the clothes volume data, clothes wetness data, the clothes wetness unevenness data, the clothes temperature data, the clothes temperature unevenness data and hot air temperature data is assigned one of values 0 to 15 and is represented as 4-bit signal. These data are input to the respective units $I_1$–$I_6$ of the input layer. Furthermore, the output data from the respective units $K_1$, $K_2$ are also assigned one of the values 0–15 and are each represented as 4-bit signal.

The calculation performed by the neural network will now be described. Reference symbols $U_{I1}$ to $U_{I6}$ designates the clothes volume data, the clothes wetness data, the clothes wetness unevenness data, the clothes temperature data, the clothes temperature unevenness data and hot air temperature data, respectively. The data $U_{I1}$–$U_{I6}$ are input to the respective units $I_1$–$I_6$ of the input layer and these data are delivered as data $V_{I1}$ to $V_{I6}$ without any modification Accordingly, the outputs $V_{I1}$ to $V_{I6}$ are equal to the respective values $U_{I1}$ to $U_{I6}$.

In the case of the middle layer, the input $U_{j1}$ of the unit $J_1$, for example, is shown by the following equation:

$$U_{j1} = \sum_i W_{j1Ii} V_{Ii} + \theta_{j1} = W_{j1Ii} V_{Ii} + W_{j1I2} V_{I2} + \ldots + W_{jiI6} V_{I6} + \theta_{j1} \tag{12}$$

where $W_{jiI1}$ is a weight factor of the unit $I_1$ against the unit $J_1$, $W_{j1I2}$ is a weight factor of the unit $I_2$ against the unit $J_1$, $W_{j1I6}$ is a weight factor of the unit $I_6$ against the unit $J_1$, and $\theta_{j1}$ is a threshold value. In unit $J_1$, the sigmoid function F is calculated based on input $U_{j1}$ and the result of calculation is rendered output $V_{j1}$ as follows:

$$V_{J1} = F(U_{Ji}) \tag{13}$$

The foregoing holds in the units $J_2$ to $J_4$.

In the case of the output layer, the input $U_{k1}$ of the unit $K_1$, for example, is shown as follows:

$$U_{K1} = \sum_i W_{K1Ji} V_{Ji} + \theta_{K1} = W_{K1J1} V_{J1} + \ldots + W_{K1J5} V_{J5} + \theta_{K1} \tag{14}$$

where $W_{K1J1}$ is a weight factor of the unit $J_1$ against the unit $K_1$, $W_{K1J2}$ is a weight factor of the unit $J_2$ against the unit $K_1$, $W_{K1J5}$ is a weight factor of the unit $J_5$ against the unit $K_1$,
and $\theta_{K1}$ is a threshold value.

In the unit $K_1$, the sigmoid function F is calculated based on input $U_{K1}$ and the result of calculation is rendered output $V_{K1}$ as follows:

$$V_{K1}=F(U_{K1}). \quad (15)$$

The foregoing holds in the unit $K_2$.

The weight factors W and the threshold values $\theta$ are represented by 4-bit signals and may take the positive and negative values and zero. For example, "0", "1" and "−1" are represented as "0000", "0001" and "1111" respectively. The uppermost bit is a negative sign bit and the result (WV) of multiplication of the weight factor W and the output V is represented by the five upper bits including the uppermost bit as the negative sign bit. Furthermore, the input U is represented by 7-bit signals and the uppermost bit is a negative sign bit. The output V is represented by 4-bit signals and takes the positive value or zero. The number of bits is not limited to those described above.

Figure 17:
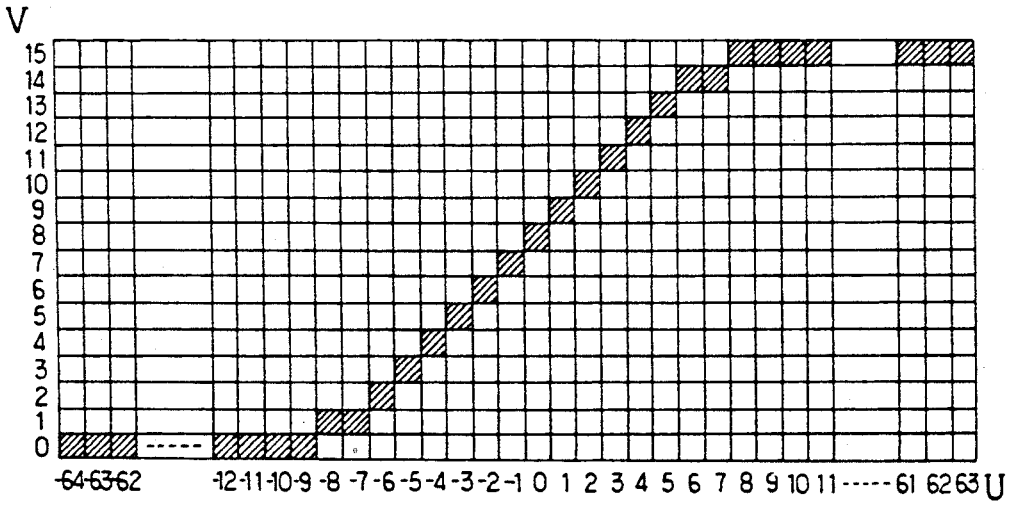
FIG. 17 shows the sigmoid function represented in matrix.

Although the value of the sigmoid function F is obtained from the above-described equation (1), the result of calculation may be obtained by way of a matrix. FIG. 17 shows an example of such a matrix. The axis of ordinates indicates the output V and the axis of abscissas the input U. For example, the output V becomes 9 when the input U is 0.

Figure 18:
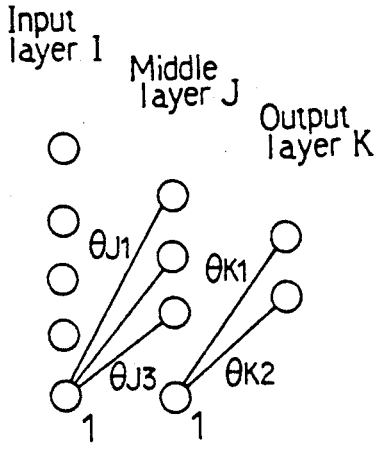
FIG. 18 is a view of the neural network for explaining the process of obtaining a threshold value.

The threshold value $\theta$ will be described with reference to FIG. 18. The units are set in the input and middle layers so as to usually have the output of "1," respectively. When the weight factors of the links from these units are represented by K and J, they can be treated as in the actual weight factors $W_{KJ}$, $W_{JI}$. The output "1" represents the maximum output value of the unit, that is, the maximum output value of the sigmoid function F. In the above-described embodiment, "15" is the maximum output value of the sigmoid function F. The threshold value may be positive, negative or zero as in the weight factor W, and the number of bits may differ.

Learning of the neural network is performed mainly at the stage of development of the products. Not all the input patterns need be learned. For example, the learning of about several ten input patterns suffices. When the weighting factor W and the threshold value $\theta$ are determined as the result of learning, these values are set to the same types of washing machines for mass production.

A manner of the neurocontrol applied to the clothes dryer of the embodiment will now be described. Clothes (not shown) are put into the drying compartment 6 and the operation of the clothes dryer is initiated. The heater 31 and the first and second motors 14, 16 are energized. Heat is generated by the heater 31. The fan 11 is driven via the belt 13 by the first motor 14. The drum 7 is rotated via the belt 15 by the second motor 16. Rotation of the drum 7 agitates the clothes in the drying compartment 6, resulting in contact of the clothes with both of the electrodes 32 and the second temperature sensor 33. Air in the drying compartment 6 is exhausted into the fan casing 9 through the filter 10 as the result of rotation of the fan 11 and particularly, that of the front vane portion 11*a*. The air exhausted into the fan casing 9 is then blown through the air circulation duct 30 to the hot air outlet 29 where the heater 31 is disposed and circulated from the hot air outlet 29 into the drying compartment 6 repeatedly. The hot air is brought into contact with the first temperature sensor 17 as the result of the above-described air circulation. Consequently, the electrodes 32 and the first and second temperature sensors 17, 33 start the detecting operations and the detection data based on the detecting operations of these sensors are input to the respective units $I_1$–$I_6$ of the input layer of the neural network.

The temperatures of the clothes and the air exhausted from the drying compartment 6 are low in a normal case where the clothes are put into the drying compartment 6 after completion of washing and dehydration thereof. Based on the input data of the temperatures of the clothes and the air exhausted from drying compartment 6, the damper mechanism 28 is operated so that the damper disk 23 is rotated via the gear 27 by the third motor 26 in order that the air inlets 24 overlapped with the respective outside air inlets 20 of the rear cover 19 are turned aside. Consequently, the outside air inlets 20 are completely closed. A volume of heat generated by the heater 31 is set to the maximum. Accordingly, the outside air is not taken into the fan casing 9 by the rear vane portion 11*b* though the fan 11 is rotated, and the air in the drying compartment 6 is only circulated by the front vane portion 11*a*. The circulated air is heated by the heater 13 and prevented from being cooled by the outside air (cooling air). The temperature of the circulated air is thus increased rapidly and the resultant hot air is supplied to the drying compartment 6 so that the clothes are heated rapidly, resulting in rapid removal of moisture from the clothes.

The temperatures of the clothes and the air from the drying compartment 6 are raised in due course. The rise of the temperature is detected and the detection data indicative of the temperature rise is input to the neurocontrol circuitry 35 of the control device 34. Based on the detection data, the damper mechanism 28 is operated so that the damper disk 23 is further rotated forward or reversed via the gear 27 by the third motor 26 in order that the air inlets 24 are gradually overlapped with the respective outside air inlets 20 of the rear cover 19, thereby gradually opening the outside air inlets 20. Consequently, the outside air is taken into the fan casing 9 through the outside air inlets 20 and the air inlets 24 by the rear vane portion 11*b* of the fan 11. The outside air taken into the fan casing 9 is caused to flow along the rear vane portion 11*b* and exhausted from the outside air outlets 21 outside the clothes dryer. This outside air intake operation is repeatedly performed. The hot air blown out of the drying compartment 6 contains moisture removed from the clothes. The hot air containing moisture is brought into contact with the outside air between the fan casing 9 and the cover plate 22. Consequently, the hot air containing moisture is cooled down and the moisture is condensed, thereby removing the moisture.

When the volume of the clothes is small, the temperature of the hot air is excessively raised and the clothes are shrunk and damaged. In such a case the detection data based on detection of the clothes volume by the electrodes 32 is input to the control device 34. The control device 34 operates to decrease the heating value of the heater 31 so that the rise of the hot air temperature is restrained. Furthermore, a volume of moisture contained in the hot air is small when the clothes volume is small. In this condition when the outside air inlets 20 are excessively opened, the temperature of the hot air is decreased more than necessary. To prevent this, the damper mechanism 28 is operated to reduce the degree of opening of the outside air inlets 20 simultaneously with the decrease of the heating value of the heater 31.

On the other hand, the temperature of the hot air is decreased when the volume of the clothes is large. In this case the detection data based on detection of the clothes volume by the electrodes 32 is input to the control device 34. The control device 34 operates to increase the heating value of the heater 31, and the damper mechanism 28 is operated to increase the degree of opening of the outside air inlets 20. Consequently, the temperature of the hot air is raised and dehumidification is enhanced.

The degree of wetness of the clothes becomes low at a final stage of the drying operation. Accordingly, the resistance value of the clothes brought into contact with the electrodes 32 is increased, resulting in drop of the detection voltage. Furthermore, the temperature of the clothes sensed by the first temperature sensor is increased at this stage of the drying operation. In this case the heating value of the heater 31 is reduced and the damper mechanism 28 is operated to decrease the degree of opening of the outside air inlets 20 to such an extent that the temperature of the hot air is maintained at a suitable value (55° to 65° C., for example) for maintaining a high drying speed.

The degree of wetness (or the degree of dryness) becomes uneven in the clothes when the clothes are difficult to be dried because of the types and sizes of the clothes and the like. In this case the wetness unevenness is detected based on the fluctuation of the detection voltage from the electrodes 32 brought into contact with the clothes and the fluctuation of the output of the second temperature sensor 33 brought into contact with the clothes. Based on the detection of the wetness unevenness, it is determined at the final stage of the drying operation that the wetness is uneven in the clothes. When this determination is made, the damper mechanism 28 is operated to decrease the degree of opening of the outside air inlets 20 and the heater 31 is controlled to reduce its heating value. The drying operation is continued until the wetness of the clothes becomes even.

In accordance with the above-described embodiment, the damper mechanism 28 (intake air volume adjusting means) and the heater 31 are controlled based on the results of detections performed at every stage of the drying operation so that an optimum drying operation is executed. Control values for the control of the damper mechanism 28 and the heater 31 have been learned by use of the training patterns by the neural network. Accordingly, optimum control values can be obtained from the neural network. Consequently, the drying operation can be performed with high heat efficiency and reliability.

Figure 19:
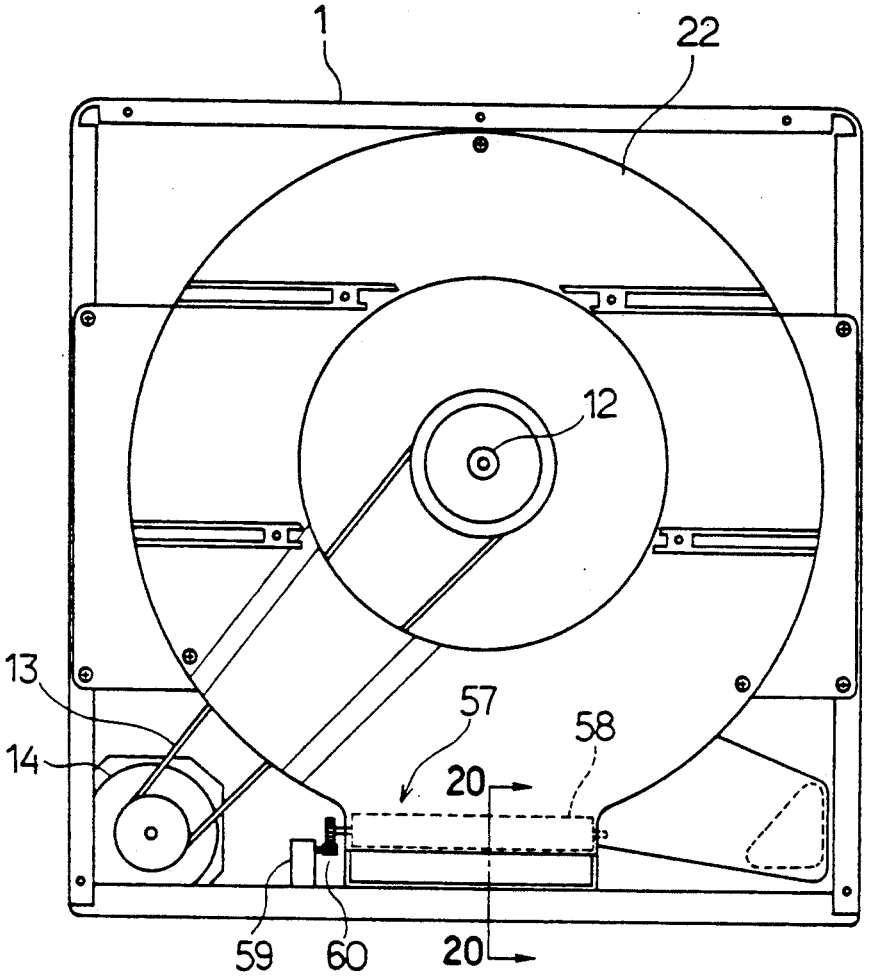
FIG. 19 is a view similar to FIG. 4 showing a second embodiment of the invention.
Figure 20:
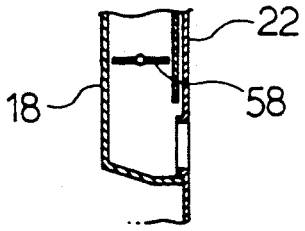
FIG. 20 is a view taken along line 20—20 in FIG. 19.

FIGS. 19 and 20 show a second embodiment of the invention. Instead of the damper mechanism 28, a damper mechanism 57 comprises a damper disk or butterfly valve 58 provided in an air path for exhausting the outside air taken in by the fan 11 and a motor 59 driven via a gear mechanism 60 for opening and closing the damper disk 58. The motor 59 and the gear mechanism 60 are disposed aside the air path. The motor 59 is controlled in the same manner as in the third motor 26 in the foregoing embodiment so that the volume of the cooling outside air supplied to the fan 11 is adjusted in the same manner as described above. Consequently, the same effect can be achieved in this embodiment as in the foregoing embodiment.

Figure 21:
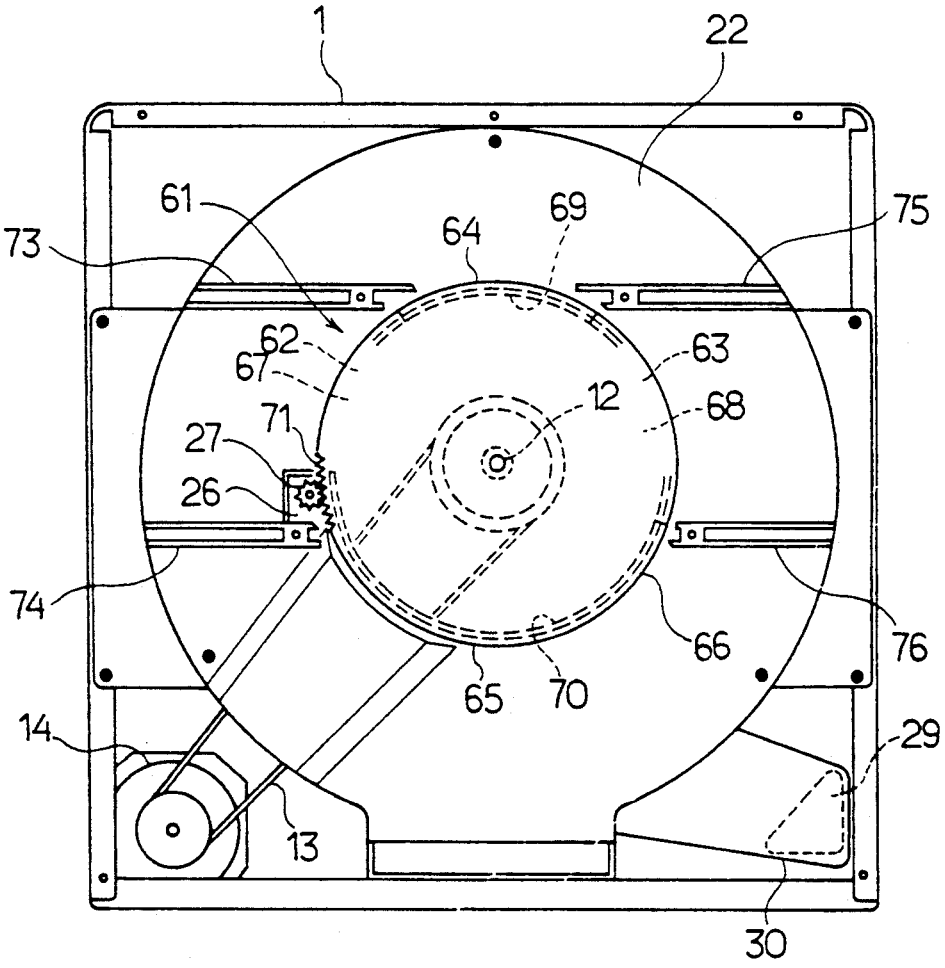
FIG. 21 is a view similar to FIG. 4 showing a third embodiment of the invention.
Figure 22:
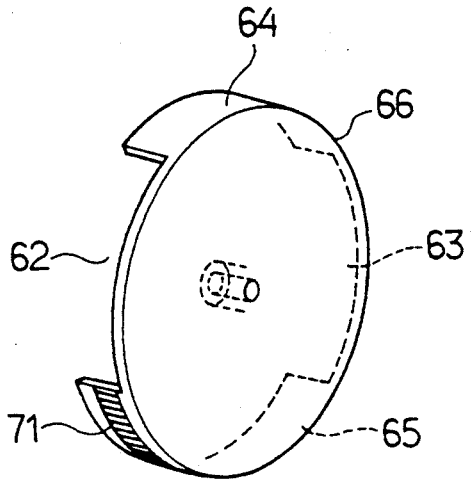
FIG. 22 is a perspective view of a damper disc.
Figure 23:
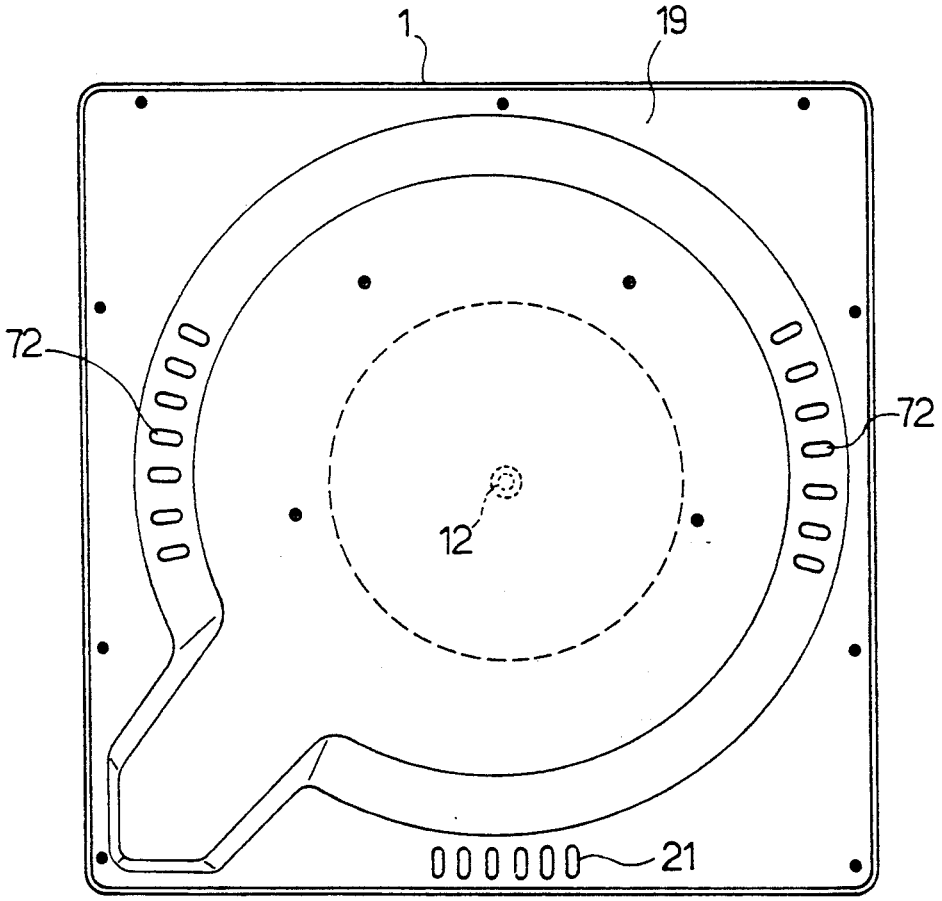
FIG. 23 is a view similar to FIG. 3.

FIGS. 21 to 23 show a third embodiment of the invention. Instead of the damper mechanism 28, too, a damper mechanism 61 comprises a damper disk 66 having two peripheral air vents 62 and 63 and two rising peripheral portions 64 and 65. The cover plate 22 has two air vents 67 and 68 and two rising portions 69 and 70. The rising portions 64, 65 of the damper disk 66 are fitted with the rising portions 69, 70 respectively and the damper disk 66 is mounted on the shaft 12. The damper disk 66 has gear teeth 71 formed on the outer peripheral face of the rising portion 65. The gear 27 mounted on the shaft of the third motor 26 is in mesh engagement with the gear teeth 71. A plurality of outside air inlets 72 are formed in both sides of the rear cover 19. The outside air inlets 72 at both sides of the rear cover 19 are communicated to the air vents 67, 68 through the air vents 62, 63 of the damper disk 66 between reinforcing ribs 73 and 74 and reinforcing ribs 75 and 76 of the cover plate 22, respectively.

In accordance with the above-described construction, the damper disk 66 is rotated by the third motor 26 so that the air vents 62, 63 are turned aside from or overlapped with the air vents 67, 68 of the cover plate 22, respectively so that the air vents 62, 63 are opened and closed. The volume of the cooling outside air taken in through the outside air inlets 72 of the rear cover 19 is thus controlled. Consequently, the same effect can be achieved in the third embodiment as in the first embodiment.

Although the drying compartment is defined in the drum in the foregoing embodiments, it may be defined in a cabinet wherein the clothes to be dried are hung on hangers and contained in it.

The foregoing disclosure and drawings are merely illustrative of the principles of the present invention and are not to be interpreted in a limiting sense. The only limitation is to be determined from the scope of the appended claims.

We claim:

1. A clothes dryer in which hot air induced by a heater is circulated from a drying compartment through a heat exchanger for drying clothes, comprising:

a) detecting means for detecting states of clothes to be dried and the like;

b) intake air volume adjusting means for adjusting a volume of cooling intake air supplied to the heat exchanger; and c) control means for controlling the intake air volume adjusting means by way of a neurocontrol based on the result of detection by the detecting means so that the volume of cooling intake air is adjusted.

2. A clothes dryer according to claim 1, wherein a heating value of the heater is further controlled by the control means by way of the neurocontrol based on the result of detection by the detecting means.

3. A clothes dryer according to claim 1, wherein the detecting means comprises clothes volume detecting means for detecting a volume of clothes to be dried, wetness detecting means for detecting wetness of the clothes to be dried, and hot air temperature detecting means for detecting the temperature of the hot air blown out of the drying compartment.

4. A clothes dryer according to claim 2, wherein the detecting means comprises clothes volume detecting means for detecting a volume of clothes to be dried, wetness detecting means for detecting wetness of the clothes to be dried, and hot air temperature detecting means for detecting the temperature of the hot air blown out of the drying compartment.

5. A clothes dryer according to claim 2, wherein the detecting means comprises clothes volume detecting means for detecting a volume of clothes to be dried, wetness detecting means for detecting wetness of the clothes to be dried, wetness unevenness detecting means for detecting a degree of wetness unevenness of the clothes to be dried, clothes temperature detecting means for detecting the temperature of the clothes to be dried, clothes temperature unevenness detecting means for detecting a degree of temperature unevenness of the clothes to be dried, and hot air temperature detecting means for detecting the temperature of the hot air blown out of the drying compartment.

* * * * *